US005967324A

United States Patent [19]

Izzo

[11] Patent Number: 5,967,324

[45] Date of Patent: Oct. 19, 1999

[54] INFLATABLE BLADDER AND METHODS FOR PROTECTING GOLF CLUB MEMBERS

[75] Inventor: Theodore-James Izzo, Evergreen, Colo.

[73] Assignee: Izzo Systems, Inc., Lakewood, Colo.

[21] Appl. No.: 08/991,496

[22] Filed: Dec. 16, 1997

[51] Int. Cl.[6] ..... B65D 81/03; A63B 55/00

[52] U.S. Cl. ..... 206/527; 206/315.4; 206/315.3; 206/522; 150/159

[58] Field of Search ..... 150/159, 160; 206/315.4, 315.3, 315.6, 522, 527

[56] References Cited

U.S. PATENT DOCUMENTS

| | | | |
|---|---|---|---|
| 1,119,508 | 12/1914 | Headley | 206/315.4 |
| 1,254,669 | 1/1918 | Fovargue | 206/315.4 |
| 2,114,870 | 4/1938 | Calkins . | |
| 2,749,958 | 6/1956 | Innes | 206/315.4 |
| 3,554,255 | 1/1971 | Mangan . | |
| 3,985,171 | 10/1976 | Summers et al. | 206/315.4 X |
| 4,174,747 | 11/1979 | Boles | 206/315.6 |
| 4,208,227 | 6/1980 | Cowan | 206/315.6 |
| 4,241,774 | 12/1980 | Pell | 206/315.6 |
| 4,420,024 | 12/1983 | Clayton | 206/315.6 |
| 4,512,465 | 4/1985 | Jobe | 206/315.4 |
| 4,664,382 | 5/1987 | Palmer et al. | 273/77 |
| 5,209,280 | 5/1993 | Gevas | 150/159 |
| 5,265,894 | 11/1993 | Dunn | 150/159 X |
| 5,314,086 | 5/1994 | Short | 206/522 X |
| 5,383,505 | 1/1995 | Cordasco, Jr. | 150/159 |
| 5,421,454 | 6/1995 | Chern | 206/315.4 |
| 5,443,156 | 8/1995 | Shioda | 150/159 X |
| 5,450,958 | 9/1995 | Shin | 206/315.6 |
| 5,515,897 | 5/1996 | Fehan | 150/159 |
| 5,624,035 | 4/1997 | Kim | 206/522 |
| 5,704,475 | 1/1998 | Jack | 206/315.4 |

OTHER PUBLICATIONS

1998 Nike Golf Accessories Catalog by Team Effort, p. 8.

*Primary Examiner*—Sue A. Weaver
*Attorney, Agent, or Firm*—Townsend and Townsend and Crew

[57] ABSTRACT

The invention provides exemplary devices and methods for protecting golf clubs when stored within a golf bag. The golf bags used in connection with the invention comprise a bag body having a bottom end and an open top end for receiving a plurality of golf clubs. The protection device comprises a collar which is attachable about the golf club heads which are held in the golf bag. Further, the collar comprises a bladder which is inflatable to compress and secure the golf clubs together.

23 Claims, 4 Drawing Sheets

Fig. 1
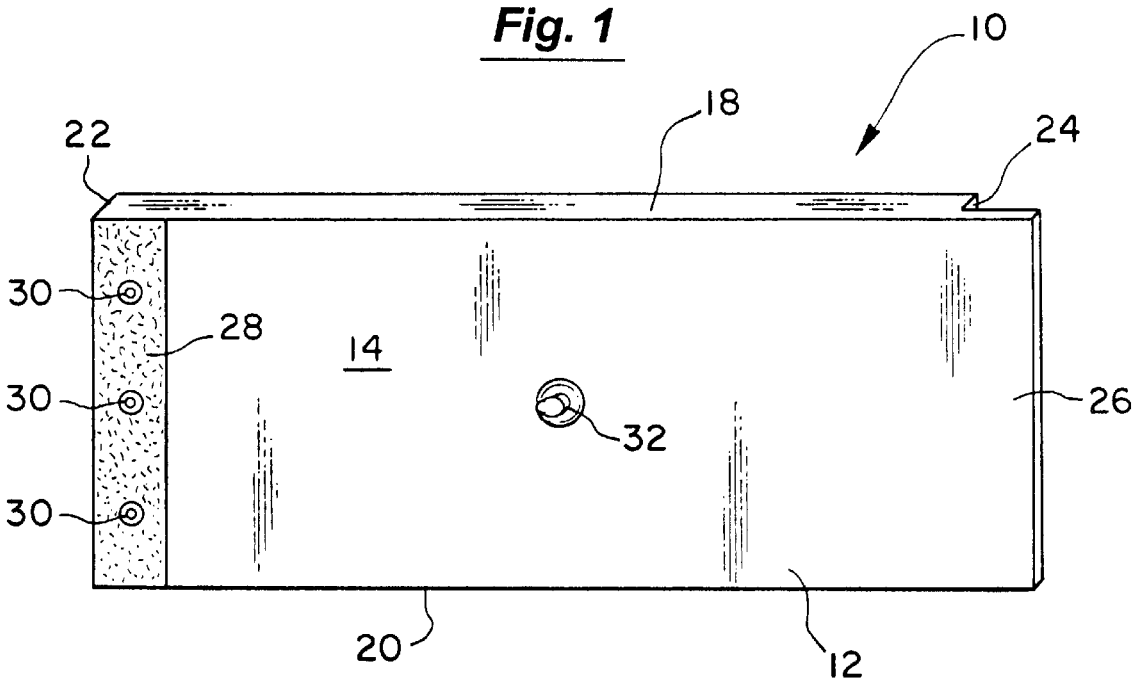
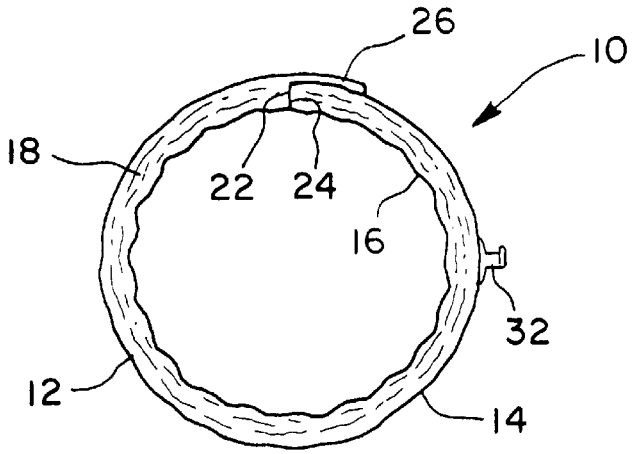
Fig. 2
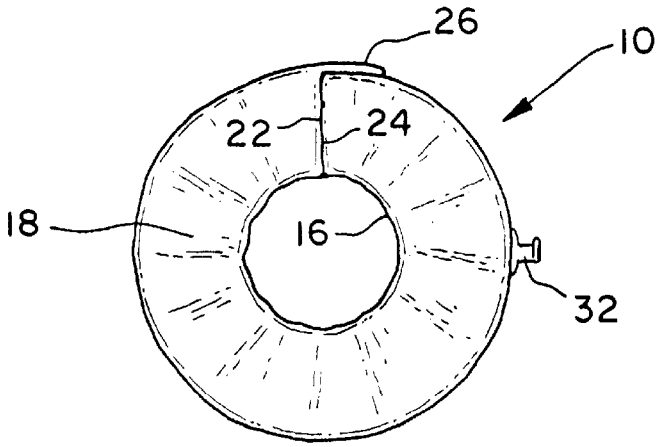
Fig. 3

INFLATABLE BLADDER AND METHODS FOR PROTECTING GOLF CLUB MEMBERS

BACKGROUND OF THE INVENTION

The invention relates generally to the field of golf, and in particular to the protection of golf clubs which are held within a golf bag. More specifically, the invention provides a removable attachment which may be affixed to a golf bag to surround the club heads and then inflated to compress the club heads together.

Golf is currently one of the most popular sports in the United States and throughout the world. In the game of golf, the golfer utilizes a set of golf clubs which can include various irons, a putter, drivers, and the like. The golf clubs are often constructed from different materials, such as metals, woods, composites, and the like, and may change from time to time as technology advances.

Typically, a set of golf clubs will be held within a golf bag until ready for use. When stored within the golf bag, the shafts of the clubs are inserted into the golf bag so that the club heads are positioned above the top end of the golf bag. In this way, the club heads are visible and may easily be located and removed by grasping the club head and pulling the club from the golf bag.

To maximize the performance of the golf clubs, it is desirable to keep them in good working order. However, this can be difficult because of the manner in which the golf clubs are stored in the golf bag. For instance, most golfers transport their golf clubs while held within a conventional golf bag. Since the clubs are loosely held within the golf bag, they are free to jostle about and can damage each other, especially if some of the club heads are constructed from wood or special alloys. Furthermore, the club heads are often directly exposed to external environment and can become damaged by external objects as the bag is transported to various locations. The potential for inflicting damage to the golf clubs is heightened when transporting the golf clubs in an airplane, an automobile, or the like, where the club heads can easily bang against other luggage or the vehicle itself.

In view of such problems, a variety of schemes have been proposed to protect golf clubs when stored within a golf bag. For example, some have proposed placing a cloth "sock" individually over some or all of the club heads. However, this scheme provides only minimal protection for the club heads. As another example, some have proposed placing the entire golf bag and clubs within a rigid, hard shell or case. However, such cases are heavy, bulky, expensive and inconvenient to carry and store.

Hence, it would be desirable to provide devices and methods for their use which would overcome or greatly reduce these and other problems associated with the storing of golf clubs within a golf bag. Such devices should be cost effective, easy to attach to a golf bag, and easy to operate. It would be further desirable if such a device were light weight so that the overall weight of the golf bag would not be greatly increased, and so that the device would be easy and convenient to store.

SUMMARY OF THE INVENTION

The invention provides exemplary devices and methods for protecting golf clubs when stored within a golf bag. The golf bags used in connection with the invention will typically be conventional, commercially available golf bags which are constructed of a bag body having a bottom end and an open top end for receiving a plurality of golf clubs. The protection device comprises a collar which is removably attachable about the golf club heads while the golf clubs are held within the golf bag. Further, the collar includes a bladder which is inflatable to compress and secure the golf clubs while they are held within the golf bag.

In one particular aspect, the collar is also configured to be removably attachable to a periphery of the top end of the golf bag. When attached to the golf bag, the collar extends around the top end and vertically above the golf clubs which are held in the golf bag. In this way, the collar will also serve to hold the golf clubs within the golf bag.

Hence, with the device of the invention a set of golf clubs can conveniently be protected simply by placing the collar around the golf club heads (and in some cases also around the top end of the golf bag) and inflating the bladder. When the golf clubs are ready to be used, the collar is deflated and removed from the clubs. After removal, the collar can conveniently be stored in a pocket of the golf bag.

In one exemplary aspect, the collar is generally rectangular in geometry and includes an outer side, an inner side, a top side, a bottom side, and two ends. With such an arrangement, the two ends may be placed together or overlapped to position the collar around the golf clubs or around the top end of the golf bag. Conveniently, the collar further includes at least one fastening mechanism to secure the two ends to each other when placed around the club heads.

In another aspect, the outer side is generally non-expansible, and the inner side is expansible to allow the bladder to expand inward to compress the golf clubs. The outer side is preferably constructed of a durable, tough material to protect the bladder from any external blows. In still another aspect, the collar further includes an air intake on the outer side, and an inflation member is provided to inject air into the air intake to inflate the bladder.

In an alternative embodiment, the invention provides an exemplary device for protecting a golf bag and a set of clubs which are held in the golf bag. The device comprises a cover for receiving the golf bag and includes a bottom end and an open top end. A collar is operably attached to the top end of the cover and includes a bladder which is inflatable to compress the golf club heads together. In this way, the golf bag may be inserted into the cover to protect the golf bag, and the collar may be inflated to protect the heads of the golf clubs.

Preferably, the cover includes an elongate slit which allows the cover to be opened when receiving the golf bag. In one aspect, the cover comprises a flexible bag.

BRIEF DESCRIPTION OF THE DRAWINGS

FIG. 1 is a perspective side view of an exemplary protection device according to the invention.

FIG. 2 is a top view of the protection device of FIG. 1 with its two ends being attached together.

FIG. 3 illustrates the protection device of FIG. 2 when inflated.

DETAILED DESCRIPTION OF THE SPECIFIC EMBODIMENTS

Figure 4:
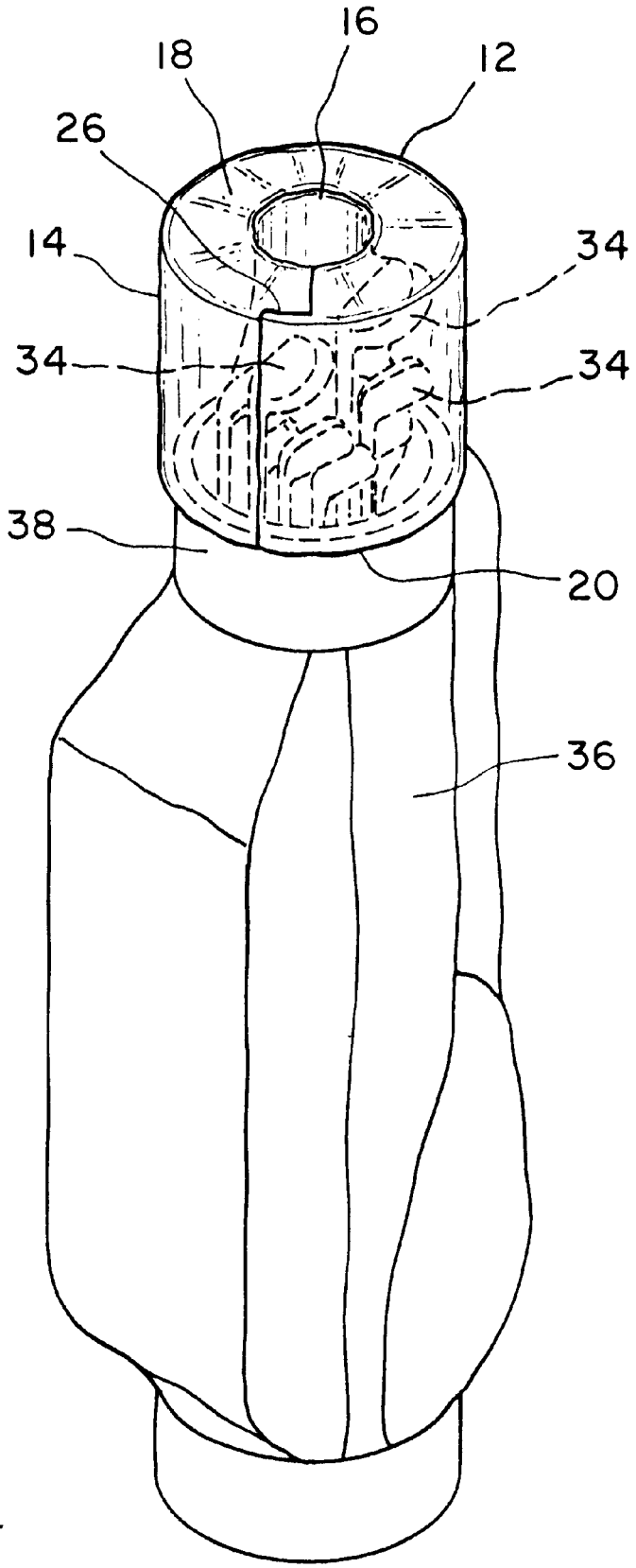
FIG. 4 illustrates the protection device of FIG. 3 when attached to a golf bag.

The invention provides exemplary devices and methods for protecting golf clubs when held within a golf bag. The devices of the invention include a collar having an inflatable bladder which is placed around the golf club heads and then inflated to compress the golf club heads together. In this way, the golf club heads will be prevented from banging into each other during transport or movement of the golf bag. Further, the outer surface of the collar protects the clubs against external impact blows.

One particular advantage of employing such a bladder is that it is relatively small and light weight and may therefore be conveniently stored. For example, the collar can be rolled up and placed into one of the pockets of the golf bag when not in use. When needed, the collar is simply placed around the club heads and inflated. By constructing the collar in this manner, the device is also relatively inexpensive for the average golf consumer.

The removable collar may be placed only around the heads of the golf clubs, or, alternatively may also be placed around the periphery of the top end of the golf bag to assist in holding the golf clubs within the golf bag. Conveniently, after the collar has been placed around the golf clubs and inflated, the combined golf bag and collar may be placed into a conventional golf bag carrying case where the collar will protect the club heads while within the carrying case.

In one alternative embodiment, the collar may be incorporated into a larger structure which protects the golf bag as well as the golf clubs. For example, the collar may be incorporated into a flexible duffle-type bag which is placed around the golf bag.

Referring now to FIG. 1, an exemplary embodiment of a protection device 10 will be described. Device 10 comprises a collar 12 having an outer side 14, an inner side 16 (see FIG. 2), a top side 18, a bottom side 20, and two ends 22 and 24. Formed within collar 12 is an inflatable bladder. Outer side 14 is preferably constructed of a tough but flexible material to protect the bladder and the golf clubs against external impact blows while still allowing collar 12 to be rolled or folded for convenient storage. Exemplary materials for constructing outer side 14 comprise plastics, polyethylene, Kevlar, coated fabrics, such as nylon or polyester, and the like.

Inner side 16 is preferably constructed of a flexible, compliant material which will move and/or expand radially inward to compress the golf club heads together when the bladder is inflated. Exemplary materials for constructing inner side 16 comprise rubber, appropriately coated stretch fabrics, plastics, polyethylene, and the like.

Collar 12 is rectangular in geometry so that when ends 22 and 24 are placed together as shown in FIGS. 2 and 3, collar 12 has a generally cylindrical geometry. However, it will be appreciated that other geometries may also be employed. Extending from end 24 is a flexible tab 26 which wraps around outer surface 14 when ends 22 and 24 are placed adjacent each other. One or more fastening mechanisms are provided to secure tab 26 to outer side 14. For example, tab 26 and outer side 14 may include a hook and loop fastener material 28, such as Velcro, and/or snaps 30. Alterative fasteners include zippers, other interlocking mechanisms, and the like. In this way, ends 22 and 24 may easily be secured to each other.

Collar 12 further includes an air intake 32 which is in communication with the bladder. In this way, collar 12 may be placed around a set of golf club heads when the bladder is deflated (see FIG. 2), and then inflated to move inner side 16 radially inward (see FIG. 3). Collar 12 is inflated by injecting air or other fluids into air intake 32. For example, inflation may be accomplished with a manual pump, a canister of a compressed gas, manual inflation with the mouth, and the like.

Figure 6:
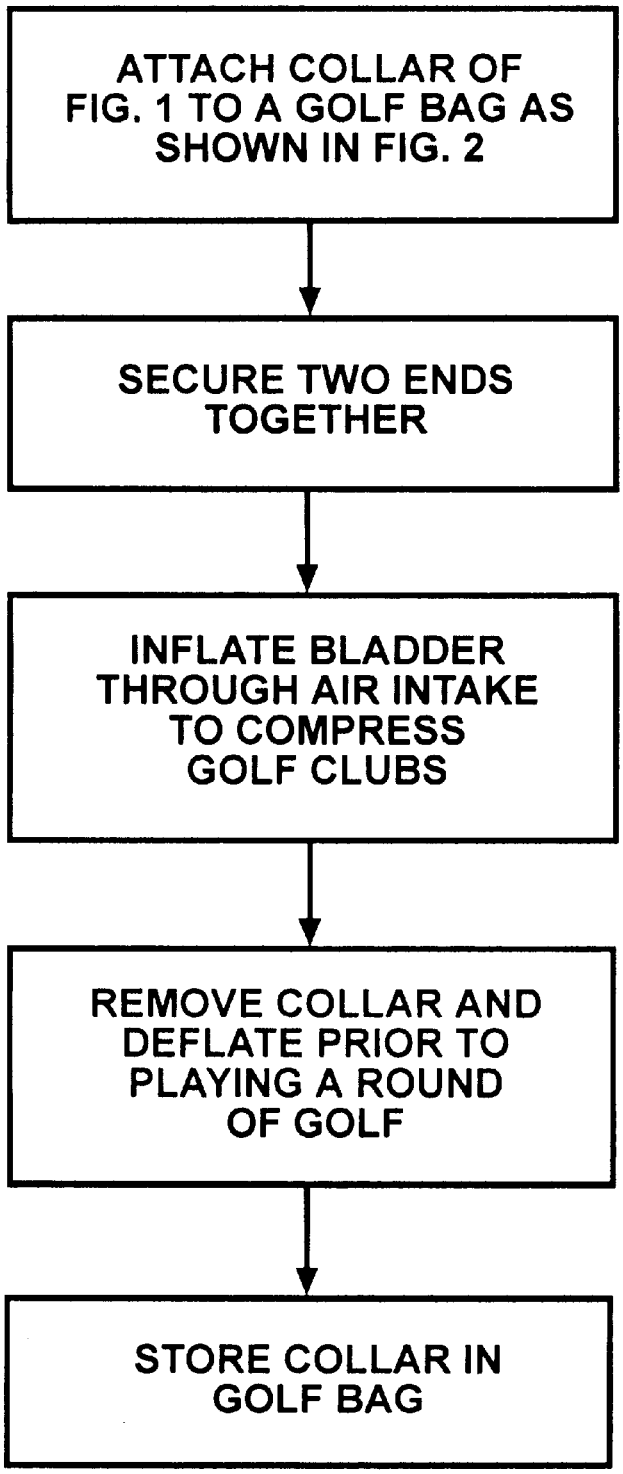
FIG. 6 illustrates an exemplary method from using a protection device with a golf bag having clubs stored therein.

Referring now to FIGS. 4 and 6 use of collar 12 to protect a set of golf clubs 34 which are held within a golf bag 36 will be described. Initially, collar 12 is wrapped around a top end 38 of golf bag 36 until ends 22 and 24 are near each other. Ends 22 and 24 are manipulated until inner side 16 is placed tightly about top end 38. Tab 26 is then secured to outer side 14 to hold collar 12 to golf bag 36. Air intake 32 is opened and a fluid is injected into the bladder to move inner side 16 radially inward. As inner side 16 moves inward, golf clubs 34 are compressed together to prevent movement of the club heads relative to each other. When sufficiently inflated, air intake 32 is closed to maintain the fluid within the bladder.

Although collar 12 is shown to be secured to top end 38 by cinching the collar around top end 38, other attachment schemes may be employed. For example, bottom side 20 could include an attachment mechanism for attachment to a top end of the golf bag. As another alternative, collar 12 could be indirectly attached to the golf bag with straps so that collar 12 would not need to be cinched around the golf bag. Further, in some cases collar 12 need not be attached to the golf bag at all. Rather, collar 12 can be extended directly around the club heads.

When ready for removal, air intake 32 is opened and tab 26 is detached from outer side 14. Collar 12 may then be rolled up or folded to force the fluid from the bladder. When deflated, collar 12 may conveniently be stored in a pocket of the golf bag or other storage location.

Figure 5:
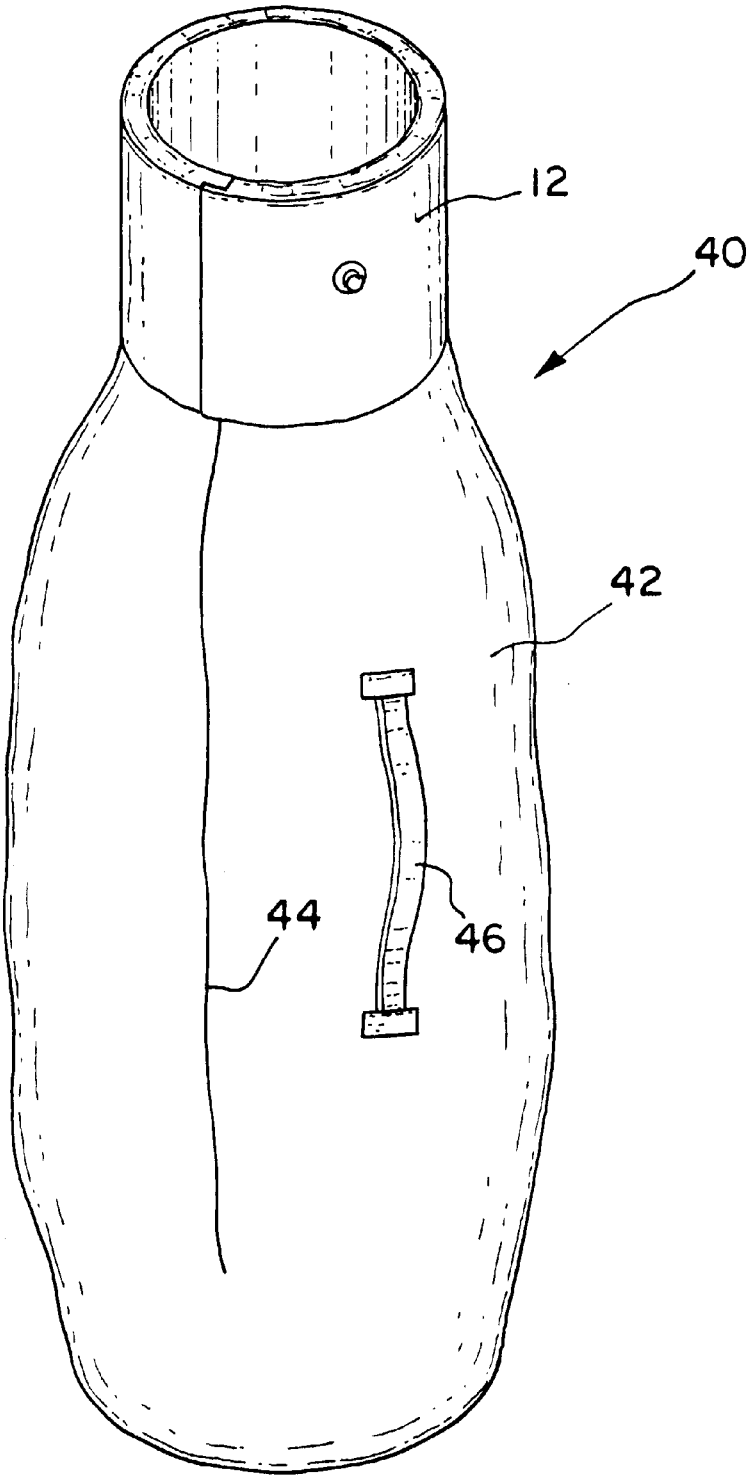
FIG. 5 is a perspective view of an alternative protection device for a golf bag and a set of golf clubs.

Referring now to FIG. 5, an alternative embodiment of a protection device 40 will be described. Device 40 comprises a flexible cover 42 which is attached to an inflatable collar. The inflatable collar may be constructed to be essentially identical to collar 12. For convenience of discussion, the same reference numerals used previously to describe collar 12 will be used in describing device 40.

Cover 42 is constructed of a flexible material, such as nylon, fabrics, leather, and the like, and is large enough to receive a golf bag. To facilitate introduction of the golf bag, cover 42 includes a slit 44 into which the golf bag is placed. Slit 44 may be provided with a zipper to close cover 42 after the golf bag has been placed into cover 42. Conveniently, a handle 46 is provided for easy carrying of device 40.

Collar 12 is affixed to cover 42, with ends 22 and 24 being aligned generally with slit 44 so that the golf bag may be placed into the cover. Collar 12 is placed about the golf clubs (while the golf clubs are stored within the golf bag) and tab 26 is secured to outer side 14 as previously described. The bladder is then inflated to compress the golf clubs in a manner similar to that previously described.

The invention has now been described in detail. However, it will be appreciated that certain changes and modifications may be made. Therefore, the scope and content of this invention are not limited by the foregoing description. Rather, the scope and content are to be defined by the following claims.

What is claimed is:

1. A device for securing golf clubs within a golf bag, wherein the golf clubs each comprise a shaft and a head, and wherein the golf bag comprises a bag body having a bottom end and an open top end for receiving the golf clubs, the device comprising:

a collar which is adapted for removable attachment about the golf club heads while the golf clubs are held within the golf bag, wherein the collar comprises a bladder which is inflatable to compress the golf clubs toward each other, wherein the collar has a top side and a bottom side and is adapted for removable attachment about the golf club heads and at least a portion of the shafts by wrapping the collar about the golf club heads and at least a portion of the shafts such that the collar extends vertically above the golf bag sufficient to extend above the golf clubs which are held in the golf bag, and wherein the collar defines an opening at the top side when inflated.

2. A device as in claim 1, wherein the collar is adapted for removable attachment about a periphery of the top end of the golf bag such that the bottom side of the collar extends around the top end.

3. A device as in claim 1, wherein the collar is generally rectangular in geometry and includes an outer side, an inner side, and two ends such that the two ends may be placed adjacent each to extend the collar around the golf club heads.

4. A device as in claim 3, wherein the collar further includes at least one fastening mechanism to secure the two ends to each other when placed around the golf club heads.

5. A device as in claim 3, wherein the outer side is generally non-expansible, and wherein the inner side is expansible to allow the bladder when inflated to expand inward to compress the golf clubs.

6. A device as in claim 5, wherein the collar further includes an air intake, and further comprising an inflation member to inject air into the air intake to inflate the bladder.

7. A device for securing golf clubs within a golf bag, wherein the golf clubs each comprise a shaft and a head, and wherein the golf bag comprises a bag body having a bottom end and an open top end for receiving the golf clubs, the device comprising:

a collar which is adapted for removable attachment about the golf club heads while the golf clubs are held within the golf bag, wherein the collar comprises a bladder which is inflatable to compress the golf clubs toward each other, wherein the collar includes an outer side, an inner side, a top side, a bottom side, and two ends such that the two ends may be placed adjacent each other to extend the collar around the golf club heads, wherein the outer side is generally non-expansible, and wherein the inner side is expansible to allow the bladder when inflated to expand inward to compress the golf clubs, and wherein the collar defines an opening at the top side when inflated.

8. A golf bag, comprising:

a bag body having a bottom end and an open top end which is adapted to receive a plurality of golf clubs;

a collar having an outer side, an inner side, and at least four ends which define an outer periphery of the collar, wherein the collar is adapted for removable attachment about the golf clubs by wrapping the collar about the golf clubs when the golf clubs are held in the bag body such that two of the ends of the collar are adjacent each other and removably attached to each other and such that the collar extends vertically above the bag body sufficient to extend above the golf clubs which are held in the bag body, wherein the collar comprises a bladder which is inflatable to compress, secure and protect the golf clubs within the bag body, and wherein the collar defines an open top end when inflated.

9. A golf bag as in claim 8, wherein the collar is generally rectangular in geometry.

10. A golf bag as in claim 9, wherein the collar further includes at least one fastening mechanism to secure the two ends to each other when placed around the golf clubs.

11. A golf bag as in claim 9, wherein the outer side is generally non-expansible, and wherein the inner side is expansible to allow the bladder when inflated to expand inward to compress the golf clubs.

12. A golf bag as in claim 11, wherein the collar further includes an air intake, and further comprising an inflation member to inject air into the air intake to inflate the bladder.

13. A device for protecting a golf bag and a set of clubs which are held in the golf bag, the device comprising:

a cover which is adapted to receive the golf bag, the cover having a bottom end and an open top end; and a collar operably attached to the top end of the cover, the collar comprising a bladder which is inflatable to surround and compress the heads of the golf clubs together when the golf bag is received into the cover, wherein the collar has a top side which defines an opening when the bladder is inflated, and wherein the opening is always defined when the collar surrounds the golf clubs.

14. A device as in claim 13, wherein the cover includes an elongate slit to open the cover when receiving the golf bag.

15. A device as in claim 13, wherein the cover comprises a flexible bag.

16. A method for securing and protecting a set of golf clubs which are held within a golf bag, wherein the golf clubs each comprise a shaft and a head, the method comprising:

wrapping a collar comprising an inflatable bladder around the golf club heads and at least a portion of the shafts while the golf clubs are held within the golf bag such that the collar extends vertically above the golf club heads, with a top side of the collar defining an opening; and inflating the bladder to compress the golf clubs together in a secured manner, with the opening remaining after inflation of the bladder and having a reduced size.

17. A method as in claim 16, further comprising attaching the collar about the periphery of a top end of the golf bag.

18. A method as in claim 17, further comprising removing the collar from the golf club heads prior to playing a round of golf.

19. A method as in claim 17, further comprising removing the collar from the golf club heads, deflating the bladder, and storing the collar in a pocket of the golf bag.

20. A method as in claim 16, wherein the collar is generally rectangular in geometry and includes a outer side, an inner side, a bottom side, and two ends, and further comprising placing the two ends adjacent each other to extend the collar around club heads.

21. A method as in claim 20, wherein the collar further includes at least one fastening mechanism, and further comprising securing the two ends to each other after placing the collar around the golf club heads.

22. A method as in claim 20, wherein the outer side is generally non-expansible and the inner side is expansible, and wherein inflation of the bladder moves the inner side inward to compress the golf clubs.

23. A method as in claim 22, wherein the collar further includes an air intake on the outer side, and further comprising injecting air into the air intake to inflate the bladder.

* * * * *